US007054809B1

(12) United States Patent
Gao

(10) Patent No.: US 7,054,809 B1
(45) Date of Patent: May 30, 2006

(54) RATE SELECTION METHOD FOR SELECTABLE MODE VOCODER

(75) Inventor: Yang Gao, Mission Viejo, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 723 days.

(21) Appl. No.: 10/126,307

(22) Filed: Apr. 19, 2002

Related U.S. Application Data

(63) Continuation-in-part of application No. 09/663,734, filed on Sep. 15, 2000.

(60) Provisional application No. 60/155,321, filed on Sep. 22, 1999.

(51) Int. Cl.
*G10L 19/02* (2006.01)

(52) U.S. Cl. ..... 704/229; 704/221; 704/201

(58) Field of Classification Search ..... 704/221, 704/223, 201, 220, 216, 214, 229; 395/2, 395/2.3
See application file for complete search history.

(56) References Cited

U.S. PATENT DOCUMENTS 5,414,796 A * 5/1995 Jacobs et al. ..... 704/221
5,778,338 A * 7/1998 Jacobs et al. ..... 704/223
6,691,084 B1 * 2/2004 Manjunath et al. ..... 704/221

OTHER PUBLICATIONS

Telecommunications Industry Association, TIA/EIA/IS-127: Enhanced Variable Rate Codec, Speech Service Option 3 for Wideband Spread Spectrum Digital Systems, 1997, 1998, 1999, 2001, pp. 4-21 to 4-28.

* cited by examiner

*Primary Examiner*—W. R. Young
*Assistant Examiner*—Huyen X. Vo
(74) *Attorney, Agent, or Firm*—Farjami & Farjami LLP

(57) ABSTRACT

There is provided rate selection methods and systems for selecting coding rates for coding frames of a speech signal to realize an average bit rate indicated by a mode. For example, a mode 0, mode 1, and a mode 2 may be defined, with each mode requiring a different average bit rate. To achieve the average bit rate of a particular mode, a coding rate is selected for each frame of the speech signal, based on the characteristics of a frame. A frame can be categorized in a class, such as noise or silence, noise-like unvoiced speech, pulse-like unvoiced speech, transition into voiced speech, unstable voiced speech, stable voiced speech. Other parameters may also be used, such as the sharpness, noise-to-signal ratio, pitch correlation, energy, and reflection coefficient. A frame may then be coded at a full-rate, a half-rate, a quarter-rate, or an eighth-rate.

38 Claims, 4 Drawing Sheets

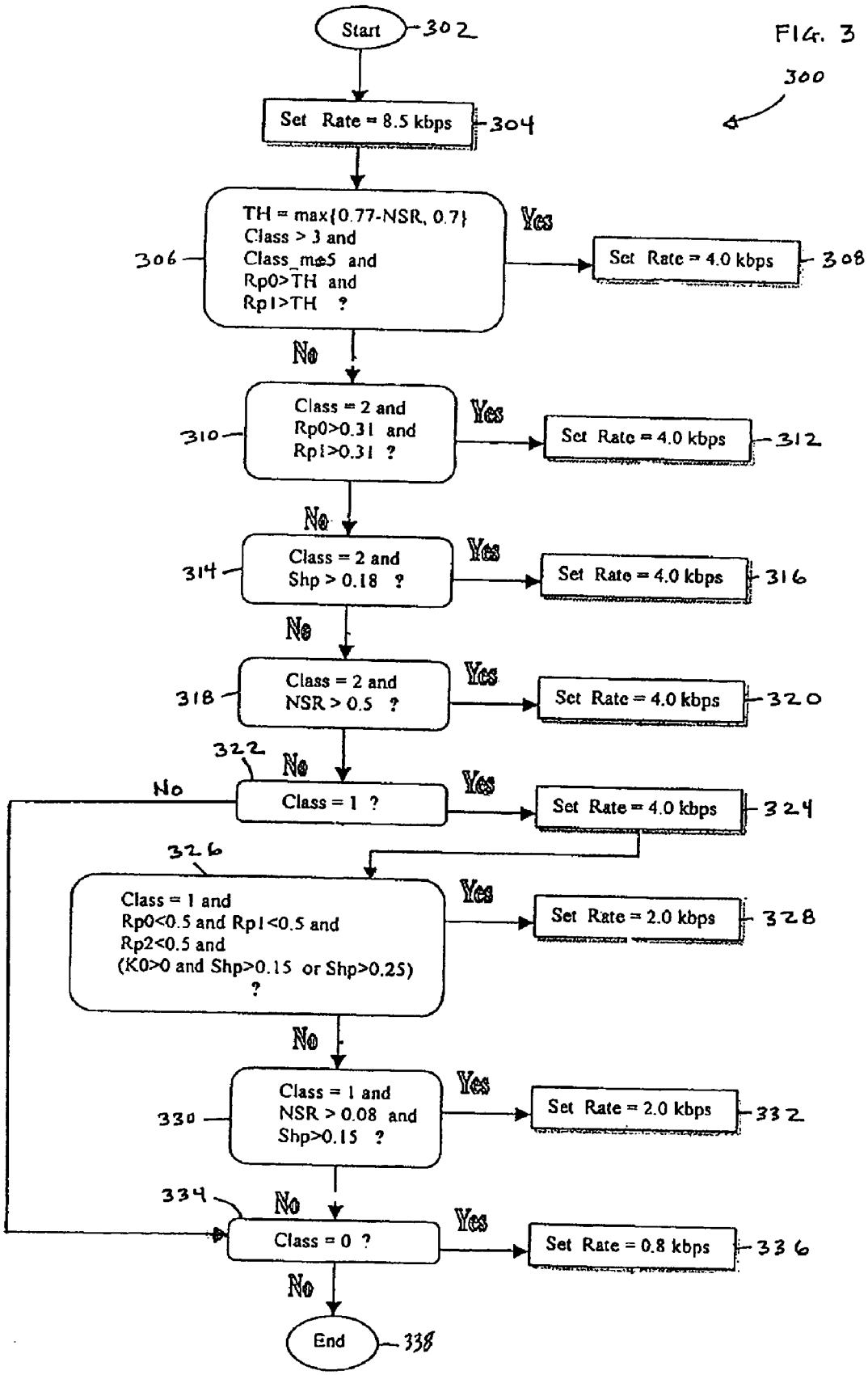
FIG. 3
300
Start
302
Set Rate = 8.5 kbps
304
TH = max{0.77-NSR, 0.7}
Class > 3 and
Class_m≠5 and
Rp0>TH and
Rp1>TH ?
306
Yes
Set Rate = 4.0 kbps
308
No
Class = 2 and
Rp0>0.31 and
Rp1>0.31 ?
310
Yes
Set Rate = 4.0 kbps
312
No
Class = 2 and
Shp > 0.18 ?
314
Yes
Set Rate = 4.0 kbps
316
No
Class = 2 and
NSR > 0.5 ?
318
Yes
Set Rate = 4.0 kbps
320
322
No
No
Class = 1 ?
Yes
Set Rate = 4.0 kbps
324
326
Class = 1 and
Rp0<0.5 and Rp1<0.5 and
Rp2<0.5 and
(K0>0 and Shp>0.15 or Shp>0.25)
?
Yes
Set Rate = 2.0 kbps
328
No
Class = 1 and
NSR > 0.08 and
Shp>0.15 ?
330
Yes
Set Rate = 2.0 kbps
332
334
No
Class = 0 ?
Yes
Set Rate = 0.8 kbps
336
No
End
338

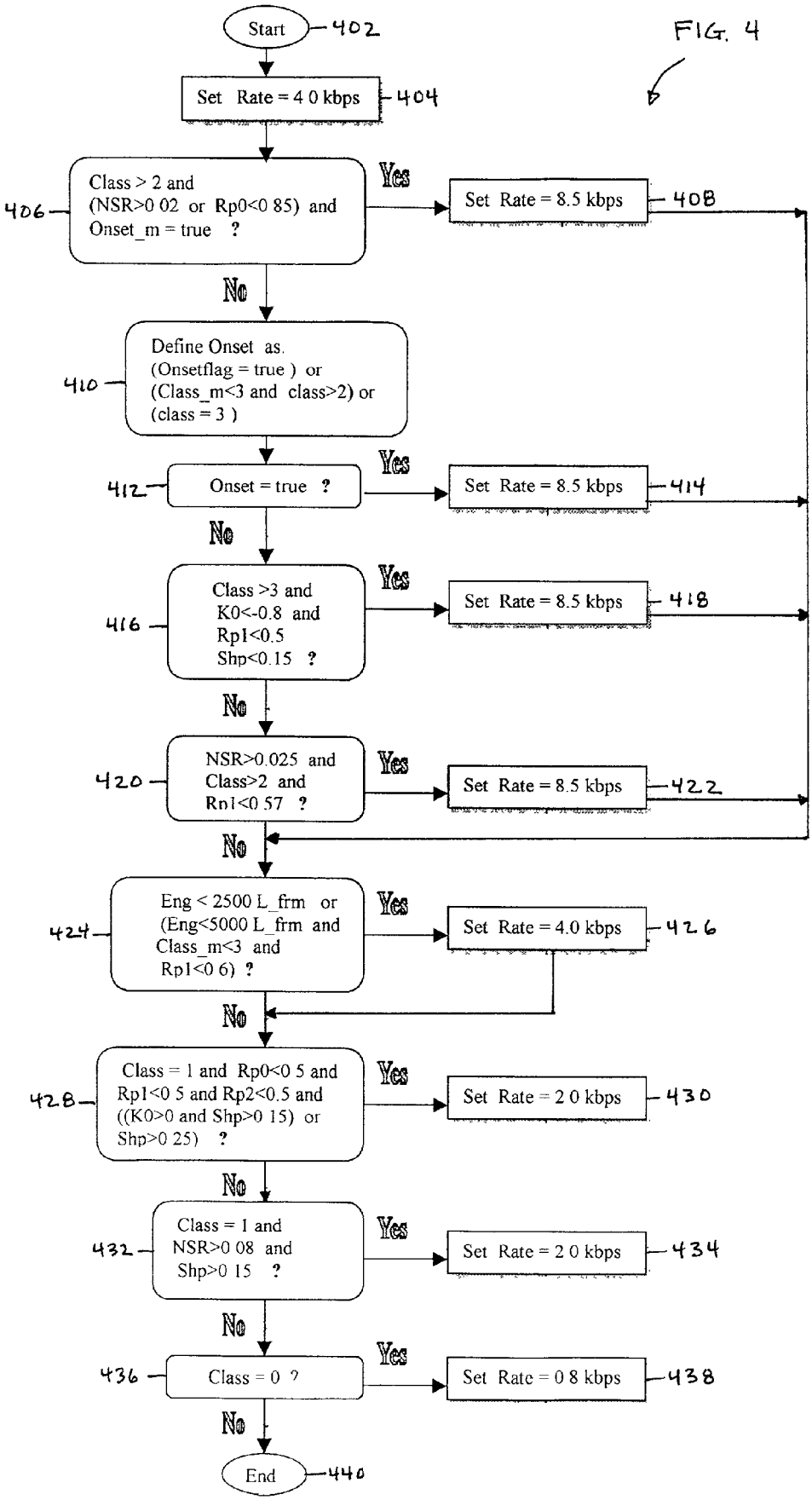
FIG. 4
Start
402
Set Rate = 4 0 kbps
404
Class > 2 and
(NSR>0 02 or Rp0<0 85) and
Onset_m = true ?
406
Yes
Set Rate = 8.5 kbps
408
No
Define Onset as.
(Onsetflag = true ) or
(Class_m<3 and class>2) or
(class = 3 )
410
Onset = true ?
412
Yes
Set Rate = 8.5 kbps
414
No
Class >3 and
K0<-0.8 and
Rp1<0.5
Shp<0.15 ?
416
Yes
Set Rate = 8.5 kbps
418
No
NSR>0.025 and
Class>2 and
Rp1<0 57 ?
420
Yes
Set Rate = 8.5 kbps
422
No
Eng < 2500 L_frm or
(Eng<5000 L_frm and
Class_m<3 and
Rp1<0 6) ?
424
Yes
Set Rate = 4.0 kbps
426
No
Class = 1 and Rp0<0 5 and
Rp1<0 5 and Rp2<0.5 and
((K0>0 and Shp>0 15) or
Shp>0 25) ?
428
Yes
Set Rate = 2 0 kbps
430
No
Class = 1 and
NSR>0 08 and
Shp>0 15 ?
432
Yes
Set Rate = 2 0 kbps
434
No
Class = 0 ?
436
Yes
Set Rate = 0 8 kbps
438
No
End
440

RATE SELECTION METHOD FOR SELECTABLE MODE VOCODER

RELATED APPLICATIONS

The present application is a Continuation-In-Part of U.S. application Ser. No. 09/663,734, filed Sep. 15, 2000, which claims the benefit of U.S. provisional application Ser. No. 60/155,321, filed Sep. 22, 1999, which are hereby fully incorporated by reference in the present application.

BACKGROUND OF THE INVENTION

1. Field of the Invention

The present invention generally relates to speech communication systems and, more particularly, to systems for digital speech coding.

2. Related Art

Communication systems include both wireline and wireless radio based systems. Wireless communication systems are electrically connected with the wireline based systems and communicate with the mobile communication devices using radio frequency ("RF") communication. Currently, the radio frequencies available for communication in cellular systems, for example, are in the cellular frequency range centered around 900 MHz and in the personal communication services ("PCS") frequency range centered around 1900 MHz. Data and voice transmissions within the wireless system have a bandwidth that consumes a portion of the radio frequency. Due to increased traffic arising from the expanding popularity of wireless communication devices, such as cellular telephones, it is desirable to reduce bandwidth of transmissions within the wireless systems.

Digital transmission in wireless radio communications is increasingly applied to both voice and data due to noise immunity, reliability, compactness or equipment and the ability to implement sophisticated signal processing functions using digital techniques. Digital transmission of speech signals involves the steps of sampling an analog speech waveform with an analog-to-digital converter, speech compression (encoding), transmission, speech decompression (decoding), digital-to-analog conversion, and playback into an earpiece or a speaker. The sampling of the analog speech waveform with the analog-to-digital converter creates a digital signal represented by a number of bits. The number of bits used in the digital signal to represent the analog speech waveform, however, requires a large portion of communication bandwidth. For example, a speech signal that is sampled at a rate of 8000 Hz (once every 0.125 ms), where each sample is represented by 16 bits, will result in a bit rate of 128,000 bits per second, or 128 Kbps.

Speech compression may be used to reduce the number of bits that represent the speech signal, thereby reducing the bandwidth needed for the transmission. However, speech compression may result in the degradation of the quality of decompressed speech. In general, a higher bit rate will result in a higher quality, while a lower bit rate will result in a lower quality.

One conventional approach to provide a higher quality speech at a lower average bit rate involves varying the degree of speech compression (i.e., varying the bit rate) depending on the part of the speech signal being compressed. Typically, parts of the speech signal for which adequate perceptual representation is more difficult (such as voiced speech, plosives, or voiced onsets) are coded and transmitted using a higher number of bits. Conversely, parts of the speech for which adequate perceptual representation is less difficult (such as unvoiced, or silence between words) are coded with a lower number of bits. The dissimilar coding rates can be attained, for example, with a variable bit rate coder having multiple codecs operating at different rates. As a result, the average bit rate for the speech signal will be relatively lower than would be the case for a fixed bit rate that provides speech of similar quality, leading to a reduction in the amount of bandwidth needed to transmit a speech signal. Although a lower bit rate is achieved through the use of variable rate coding, systems utilizing this approach remain inefficient. For example, the determination of which rate to use for coding a frame of the speech signal is often not correct, leading to situations where unvoiced or silence frames are coded at higher rates than frames containing actual voice activity.

Thus, there is an intense need in the art for systems and methods of speech coding that can reduce the amount of bandwidth required for speech signal transmission by achieving lower average bit rates, while maintaining high quality.

SUMMARY OF THE INVENTION

In accordance with the purpose of the present invention as broadly described herein, there is provided rate selection methods and systems for selecting coding rates for coding a plurality of frames of a speech signal to realize an average bit rate indicated by a mode. For example, a mode 0 having an average bit rate not greater than the average bit rate of the standard Enhanced Variable Rate Codec ("ERVC"), a mode 1 having an average bit rate not greater than 75% of the ERVC, or a mode 2 having an average bit rate not greater than 55% of the ERVC, may be defined.

In order to achieve the desired average bit rate of a particular mode, a suitable coding rate is selected for each frame of the speech signal. The selection of the suitable coding rate is based on the characteristics of a frame. In one aspect of the invention, a frame is categorized in any one of a plurality of classes, depending on the characteristics of the frame. For example, a first class indicates background noise or silence, a second class indicates noise-like unvoiced speech a third class indicates pulse-like unvoiced speech, a fourth class indicates transition into voiced speech, a fifth class indicates unstable voiced speech, and a sixth class indicates stable voiced speech. Other parameters may be extracted from the speech signal to characterize a frame and aid in determining the proper coding rate to satisfy the average bit rate requirement of the particular mode. These features may include, for example, the sharpness, noise-to-signal ratio, pitch correlation, energy, and reflection coefficient.

Depending on the characterization of a frame as defined by the various parameters discussed above, the frame may be coded at a full-rate, a half-rate, a quarter-rate, or an eighth-rate. For example, the full-rate may be approximately 8.0 Kbps, the half-rate may be approximately 4.0 Kbps, the quarter rate may be approximately 2.0 Kbps, and the eighth rate may approximately 0.8 Kbps. The selection of different coding rates to code frames of a speech signal, based on an analysis and characterization of the frames, to achieve a desired average bit rate reduces bandwidth requirements, while achieving high quality.

These and other aspects of the present invention will become apparent with further reference to the drawings and specification, which follow. It is intended that all such additional systems, methods, features and advantages be included within this description, be within the scope of the present invention, and be protected by the accompanying claims.

BRIEF DESCRIPTION OF DRAWINGS

The features and advantages of the present invention will become more readily apparent to those ordinarily skilled in the art after reviewing the following detailed description and accompanying drawings, wherein:

FIG. 3 illustrates an exemplary flow diagram of a speech compression method for use with the speech compression system of FIG. 1; and FIG. 4 illustrates an exemplary flow diagram of a speech compression method for use with the speech compression system of FIG. 1.

DESCRIPTION OF EXEMPLARY EMBODIMENTS

The present invention may be described herein in terms of functional block components and various processing steps. It should be appreciated that such functional blocks may be realized by any number of hardware components and/or software components configured to perform the specified functions. For example, the present invention may employ various integrated circuit components, e.g., memory elements, digital signal processing elements, logic elements, and the like, which may carry out a variety of functions under the control of one or more microprocessors or other control devices. Further, it should be noted that the present invention may employ any number of conventional techniques for data transmission, signaling, signal processing and conditioning, tone generation and detection and the like. Such general techniques that may be known to those skilled in the art are not described in detail herein. It should be appreciated that the particular implementations shown and described herein are merely exemplary and are not intended to limit the scope of the present invention in any way.

Figure 1:
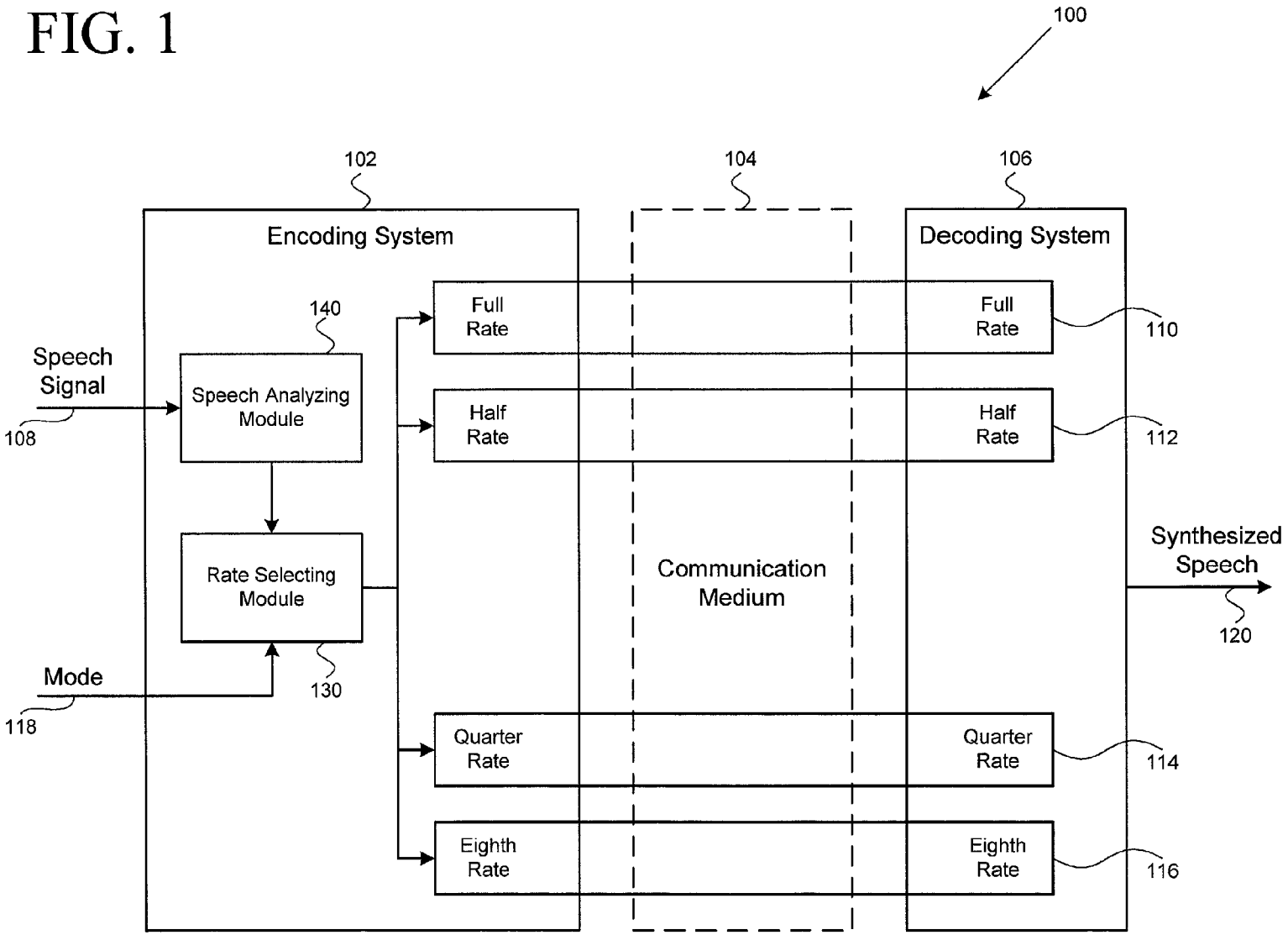
FIG. 1 illustrates a speech compression system according to one embodiment of the present invention.

FIG. 1 illustrates exemplary speech compression system 100 for encoding and decoding speech signals in accordance with one embodiment of the present invention. As shown, speech compression system 100 includes encoding system 102, communication medium 104 and decoding system 106, which may be connected as illustrated. Speech compression system 100 may be any suitable system configured to receive and encode speech signal 108, and then decode speech signal 108 to generate post-processed synthesized speech 120. For example, in a typical communication system, a wireless communication system may be electrically connected with a public switched telephone network ("PSTN") within the wireline-based communication system. Within the wireless communication system, a plurality of base stations is typically used to provide radio communication with mobile communication devices such as a cellular telephone or a portable radio transceiver.

As shown in FIG. 1, speech compression system 100 operates to receive speech signal 108, which is emitted by a sender (not shown) and captured, for example, by a microphone (not shown) and digitized by an analog-to-digital converter (not shown). The sender may be a human, a musical instrument or any other device capable of emitting analog signals. Speech signal 108 can represent any type of sound, such as voice speech, unvoiced speech, background noise, silence, music, etc.

In speech compression system 100, encoding system 102 is configured to encode speech signal 108. Encoding system 102 may be part of a mobile communication device, a base station or any other wireless or wireline communication device that is capable of receiving and encoding speech signal 108 digitized by an analog-to-digital converter. Wireline communication devices may include Voice over Internet Protocol ("VoIP") devices and systems, for example. Encoding system 102 segments speech signal 108 into frames to generate a bitstream. In one embodiment, speech compression system 102 uses frames comprising 160 samples that, at a sampling rate of 8000 Hz, correspond to 20 milliseconds per frame. The frames represented by the bitstream may be provided to communication medium 104.

Communication medium 104 may be any medium or channel capable of carrying the bitstream generated by encoding system 102. Communication medium 104 may also include transmitting devices and receiving devices for use in communicating the bitstream. For example, communication medium 104 can include communication channels, antennas and associated transceivers for radio communication in a wireless communication system. Alternatively, communication medium 104 can be a storage medium, such as a memory device, or any device capable of storing and retrieving the bitstream generated by encoding system 102. Communication medium 104 operates to transmit the bitstream generated by encoding system 102 to decoding system 106.

Decoding system 106 receives the bitstream from communication medium 104 and may be part of a mobile communication device, a base station or any wireless or wireline communication device that is capable of receiving the bitstream. Decoding system 16 operates to decode the bitstream and generate post-processed synthesized speech 120 in the form of a digital signal. Post-processed synthesized speech 120 may then be converted to an analog signal by a digital-to-analog converter (not shown). The analog output of the digital-to-analog converter may be received by a receiver (not shown) that may be a human ear, a magnetic tape recording device, a speech recognition device, or any other device capable of receiving an analog signal. Alternatively, a digital recording device, a speech recognition device, or any other device capable of receiving a digital signal may receive post-processed synthesized speech 120.

As illustrated in FIG. 1, speech compression system 100 of the present embodiment also includes mode signal line 118. Mode signal line 118 carries a mode signal that controls speech compression system 100 by indicating the desired average bit rate for the bitstream. The mode signal may be generated externally by, for example, a wireless communication system using a mode signal generation module. The mode signal generation module may determine the mode signal based on a plurality of factors, such as the desired quality of post-processed synthesized speech 120, the available bandwidth, the services contracted by a user or any other factor. The mode signal may also be controlled and selected by the communication system within which speech compression system 100 is operating.

In one embodiment, the mode signal being carried on mode signal line 118 may identify one of a number of modes, such as mode 0, mode 1 and mode 2. Each of such exemplary three modes may indicate a different desired average bit rate, which can vary the percentage of usage of each of codecs 110, 112, 114 and/or 116. For example, mode 0 may be referred to as a premium mode in which most of the frames may be coded with full-rate codec 110. In one embodiment, mode 0 may be set to have an average bit rate no greater than the average bit rate for the Enhanced Variable Rate Codec ("EVRC") of the Telecommunication Industry Association ("TIA") IS-127, which is hereby incorporated by reference. Mode 1 may be referred to as a standard mode in which frames with high information content, such as onset and some voiced frames, may be coded with the full-rate. In one embodiment, mode 1 may be set to have an average bit rate no greater than approximately 70% of the average bit rate for the EVRC. Mode 2 may be referred to as an economy mode in which only a few frames of high information content may be coded with full-rate codec 110. In one embodiment, mode 2 may be set to have an average bit rate no greater than approximately 55% of the average bit rate for the EVRC. It is appreciated that additional or less modes having alternative average bit rates are also possible.

In one embodiment, full-rate codec 110, half-rate codec 112, quarter-rate codec 114 and eighth-rate codec 116 generate respectively 170 bits, 80 bits, 40 bits and 16 bits per frame. The size of the bitstream of each frame corresponds to a bit rate, namely 8.5 Kbps for full-rate codec 110, 4.0 Kbps for half-rate codec 112, 2.0 Kbps for quarter-rate codec 114 and 0.8 Kbps for eighth-rate codec 116. However, fewer or more codecs as well as other bit rates are possible in alternative embodiments. By processing the frames of speech signal 108 with the various codecs, the average bit rate indicated by the mode signal is achieved.

Continuing with FIG. 1, the mode signal is provided to rate selecting module 130. In a manner described in greater detail below in relation to FIGS. 2, 3, and 4, depending on the desired average bit rate indicated by the mode signal, rate selection module 130 determines which of codecs 110, 112, 114, and 116 should be used to encode a particular frame of speech signal 108. The determination performed by rate selecting module 130 as to which codec to use may also based on the characteristic and content of the frame. As shown, speech signal 108 is processed by speech analyzing module 140, which can be configured to analyze the properties of each frame of speech signal 108 and to provide the results of the analysis to rate selecting module 130. For example, in processing speech signal 108, speech analyzing module 140 can extract such information as the signal energy, noise energy (i.e., the background noise of the speech signal), frame length, pitch, magnitude, and spectral envelope of the frame.

Speech analyzing module 140 can also have modules (not shown) for detecting voice and non-voice activity and for classifying the contents of the frame. For example, speech analyzing module 140 can classify a frame of speech signal 108 in any number of defined classes, such as the following six (6) classes: class 0 is background noise or silence; class 1 is noise-like unvoiced speech; class 2 is pulse-like unvoiced speech; class 3 is transition into voiced speech; class 4 is unstable voiced speech; and class 5 is stable voiced speech.

Figure 2:
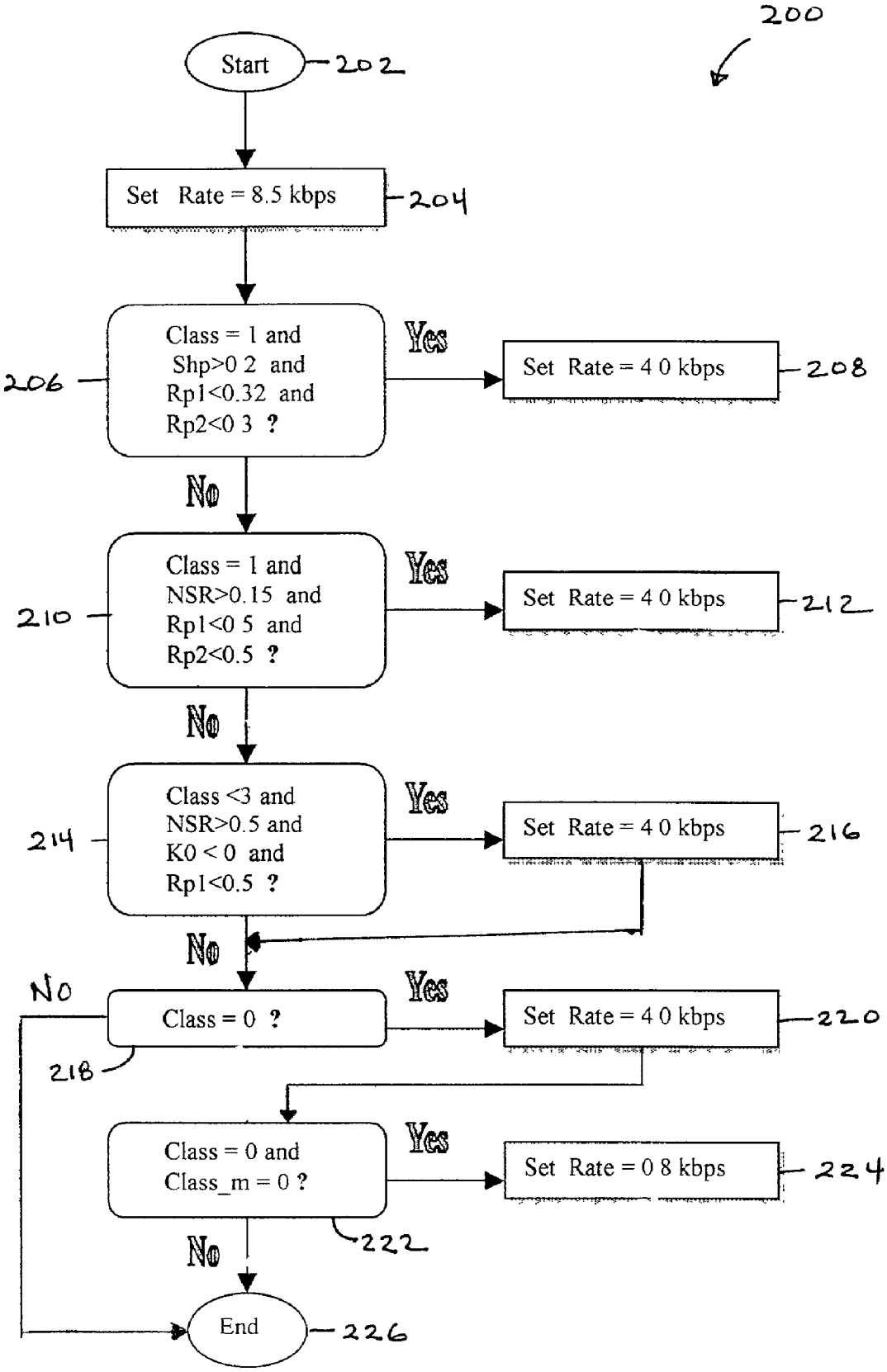
FIG. 2 illustrates an exemplary flow diagram of a speech compression method for use with the speech compression system of FIG. 1.

Referring now to FIG. 2, rate selection method 200 illustrates some exemplary steps for appropriately selecting codecs to achieve a desired bit rate, in accordance with one embodiment of the present invention. More particularly, rate selection method 200 is directed to rate selection for mode 0, or premium mode, which may be defined as having an average bit rate no greater than the average bit rate for the EVRC. It is appreciated that rate selection method 200 can be performed by a rate selecting module, such as rate selecting module 130 of encoding system 102 illustrated in FIG. 1, for each frame of an incoming speech signal. As shown, rate selection method 200 begins at step 202 and continues to step 204, where coding rate is set at 8.5 Kbps (i.e., the full-rate codec is selected) as a default rate for coding the present frame.

Next, at step 206, rate selecting module 130 uses the information provided by speech analyzing module 140 to determine whether the characteristics of the frame is such that the default rate selection should be changed. At step 206, a first test is performed to determine if (a) the frame is classified in class 1, (b) the sharpness ("Shp") is greater than approximately 0.2, (c) the pitch correlation of first-half frame ("Rp1") is less than approximately 0.32, and (d) the pitch correlation of second-half frame ("Rp2") is less than approximately 0.3. If so, then method 200 continues to step 208, where the rate is adjusted from 8.5 Kbps to 4.0 Kbps (i.e., the half-rate codec is selected).

By way of definition, the sharpness parameter, i.e., Shp, of a frame is calculated by dividing the average magnitude of a frame by the its peak magnitude, as shown in Equation 1, below:

Equation 1:

$$Shp = \frac{\sum_{n=0}^{L} \text{abs}(\text{magnitude}(n))}{\text{peak magnitude}}$$

where L is the frame length.

Also, Rp1 is defined as the normalized correlation between the pitch of the first half of the present frame and the pitch of the first half of the preceding frame processed by encoding system 102, while Rp2 is the normalized correlation between the pitch of the second half of the present frame and the pitch of the second half of the preceding frame. For example, Rp1 may be calculated according to Equation 2, below:

Equation 2:

$$Rp1 = \frac{\sum_{i=0}^{L-1} v_1(i)v_2(i)}{\sqrt{\left(\sum_{i=0}^{L-1} v_1^2(i)\right)\cdot\left(\sum_{i=0}^{L-1} v_2^2(i)\right)}}$$

where L is the length of a half frame, $v_1$ is the pitch of the first half frame of the present frame, and $v_2$ is the pitch of the first half frame of the preceding frame. The pitch correlation is an indication of the periodicity, and a higher pitch correlation points to a greater likelihood of actual speech activity.

Continuing with FIG. 2, if the first test of step 206 results in a negative, i.e., if one or more of the parameters (a)–(d) of step 206 is false, then rate selection method 200 continues to step 210, where a second test is performed to determine whether the default rate of 8.5 Kbps should be adjusted. At step 210, a second test is performed to determine if (a) the frame is classified in class 1, (b) the noise-to-signal ratio ("NSR") is greater than approximately 0.15, (c) the Rp1 is less than approximately 0.5, and (d) the Rp2 is less than approximately 0.5. If so, method 200 proceeds to step 212, where the coding rate is set at 4.0 Kbps. In one embodiment, the NSR may be calculated according to Equation 3, below:

Equation 3:

$$NSR = \sqrt{\frac{\text{noise energy}}{\text{signal engery}}}$$

where the noise energy is the background energy of the signal, and the signal energy is the noise energy plus the energy of the current frame. The background energy may be determined by a voice activity detector, for example.

Returning to step 210, if the second test results in a negative, i.e., if one or more of the parameters (a)–(d) of step 210 is false, then rate selection method 200 continues to step 214. At step 214, a third test is performed to determine whether the default rate of 8.5 Kbps should be changed. The third test of step 214 determines whether (a) the present frame is classified in a class less than class 3 (i.e. classes 0, 1 or 2), (b) the NSR is greater than approximately 0.5, (c) the reflection coefficient ("K0") is less than approximately 0, and (d) the Rp1 is less than approximately 0.5. If so, then rate selection method 200 proceeds to step 216, where the default coding rate of 8.5 Kbps is changed to 4.0 Kbps. The reflection coefficient, i.e., K0, indicates the tilt of the frame's spectral envelope and may be a linear prediction coding ("LPC") reflection coefficient, for example. Typically, a lower K0 value—for example, a more negative K0—indicates a greater likelihood of voice activity.

After either step 214 or 216, rate selection method 200 continues to step 218, where a fourth test is performed. The fourth test performed at step 218 determines if the frame is classified in class 0. If the frame is classified in class 0, then method 200 proceeds to step 220, where the rate is set at 4.0 Kbps, after which method 200 continues to step 222. If the fourth test of step 218 results in negative, i.e., if the frame is not classified in class 0, then method 200 proceeds to, and ends at, step 226 with the default rate of 8.5 Kbps retained as the rate at which to code the present frame.

Turning to step 222 of method 200, a fifth test is performed to determine if (a) the classification of the present frame is 0, and (b) the classification of the preceding frame (i.e., "Class_m") is 0. If the fifth test of step 222 determines that both the present frame and the preceding frame are classified in class 0, then method 200 continues to step 224, where the rate is set to 0.8 Kbps (i.e., the eighth-rate codec is selected to code the present frame). If the fifth test of step 222 determines that either one of the frames (i.e., the present and preceding frames) is not classified in class 0, then method 200 continues to, and ends at, step 226. In such case, the present frame is coded at the default coding rate of 8.5 Kbps. Although not shown, steps 208, 212 and 224 also end at step 226, wherein the present frame is coded at 4.0 Kbps if step 226 is entered from one of steps 208 or 212, or at 0.8 Kbps if step 226 is entered from step 224.

Referring now to FIG. 3, rate selection method 300 illustrates the steps for appropriately selecting codecs to achieve a desired bit rate, in accordance with one embodiment. More particularly, rate selection method 300 is directed to rate selection for mode 1, or standard mode, which may be defined as having an average bit rate no greater than 70% of the average bit rate for the EVRC. As shown, rate selection method 300 begins at step 302 and continues to step 304, where a default rate of 8.5 Kbps is set as the coding rate for the present frame.

Next, at step 306, a threshold value ("TH") for the frame is set as the greater of either (i) 0.7, or (ii) 0.77 less the NSR. Also at step 306, a first test is performed to determine if (a) the present frame is classified in a class greater than class 3 (i.e. class 4 or 5), (b) Class_m is 5, (c) the Rp0 is greater than the threshold value TH, and (d) Rp1 is greater than the threshold value TH. If so, rate selection method 300 proceeds to step 308, where the coding rate is set at 4.0 Kbps. By way of explanation, the Rp0 is the normalized correlation between the pitch of the second half frame of the preceding frame and the pitch of the second half frame of the frame ahead of the preceding frame.

If at step 306, the first test results in negative, i.e., if one or more of the parameters (a)–(d) of the first test is false, then rate selection method 300 continues to step 310, where a second test is performed. At step 310, the second test determines if (a) the frame is classified in class 2, (b) the Rp0 is greater than approximately 0.31, and (c) the Rp1 is greater than approximately 0.31. If so, method 300 continues at step 312, where the coding rate is set at 4.0 Kbps. However, if any of the parameters (a)–(d) of the second test is false, method 300 continues to step 314.

At step 314 of rate selection method 300, a third test is performed to determine if (a) the present frame is classified in class 2, and (b) the Shp is greater than approximately 0.18. If the third test of step 314 determines that the frame is classified in class 2 and the Shp is greater than approximately 0.18, then method 300 proceeds to step 316, where the coding rate is set at 4.0 Kbps. Otherwise, method 300 continues to step 318, where a fourth test is performed to determine if (a) the frame is classified in class 2, and (b) the NSR is greater than approximately 0.5. If so, then the coding rate is set at 4.0 Kbps at step 320.

If the fourth test performed at step 318 is false, then rate selection method 300 continues to step 322, where a fifth test is performed to determine whether the frame is classified in class 1, in which case method 300 continues to step 324, where the coding rate is set at 4.0 Kbps, and then continues to step 326. If the fifth test of step 322 determines that the frame is not classified in class 1, then method 300 proceeds to step 334.

At step 326 of rate selection method 300, a sixth test is performed to determine if (a) the frame is classified in class 1, (b) Rp0 is less than approximately 0.5, (c) Rp1 is less than approximately 0.5, (d) Rp2 is less than approximately 0.5, and (e) either (K0 is greater than approximately 0 and Shp is greater than approximately 0.15) or Shp is greater than approximately 0.25. If so, then rate selection method 300 proceeds to step 328, where the coding rate is set at 2.0 Kbps. On the other hand, if the sixth test of step 326 results in negative, i.e. if any one of the parameters (a)–(e) of step 326 is false, then method 300 continues to step 330.

At step 330, a seventh test is performed to determine if (a) the frame is classified in class 1, (b) the NSR is greater than approximately 0.08, and (c) the Shp is greater than approximately 0.15. If so, then the coding rate is set at 2.0 Kbps at step 332. However, if the seventh test of step 330 determines that any of the parameters (a)–(c) is false, then rate selection method 300 continues to step 334, where an eighth test is performed to determine whether the frame is classified in class 0. If the eighth test determines that the frame is classified in class 0, then method 300 continues to step 336, where the coding rate is set at 0.8 Kbps. If it is determined at step 334 that the frame is not classified in class 0, then rate selection method 300 proceeds to, and ends at, step 338 with the rate remaining at 8.5 Kbps, as set initially. Although not shown, steps 308, 312, 316, 320, 324, 328, 332 and 336 also end at step 338, wherein the present frame is coded at 4.0 Kbps if step 338 is entered from one of steps 308, 312, 316, 320 or 324, at 2.0 Kbps if step 338 is entered from one of steps 328 or 332, or at 0.8 Kbps if step 338 is entered from step 336.

Referring now to FIG. 4, rate selection method 400 illustrates the steps for appropriately selecting codecs to achieve a desired bit rate, in accordance with one embodiment of the present invention. More particularly, rate selection method 400 is directed to rate selection for mode 2, or economy mode, which may be defined as having an average bit rate no greater than 55% of the average bit rate for the EVRC. As shown, rate selection method 400 begins at step 402 and continues to step 404, where the default rate of 4.0 Kbps is set as the coding rate for the present frame.

Next, at step 406, a first test is performed to determine if (a) the present frame is classified in a class above class 2, (b) the NSR is greater than approximately 0.02 or the Rp0 is greater than approximately 0.85, and (c) that Onset_m is true. If so, then method 400 continues to step 408, where the default coding rate of 4.0 Kbps is changed and the coding rate for the present frame is set at 8.5 Kbps, and rate selection method 400 continues to step 424.

By way of explanation, onset is a parameter referring to an indication of a frame with a sudden change from unvoiced to voiced. For example, if there is an indication of a sudden change from unvoiced to voiced speech going from a preceding frame to the present frame, then the onset condition of the present frame (i.e., "Onset") is deemed to be true. Otherwise, Onset is deemed to be false. Onset_m, or "memorized Onset," refers to the onset condition for the frame preceding the present frame or current iteration of method 400.

Continuing with FIG. 4, if the first test of step 406 determines instead that any of the parameters (a)–(c) is false, then rate selection method 400 continues to step 410. At step 410, Onset (i.e., the onset condition of the present frame) is set as "true" if, in one embodiment, any of the following conditions is satisfied: (1) the Onsetflag is true, indicating that a sudden change from unvoiced to voiced speech has been detected between the preceding frame and the present frame; or (2) the preceding frame is classified in a class below class 3 and the present frame is classified in a class above class 2; or (3) the present frame is classified in class 3. Thus, if any of the three conditions (1)–(3) is satisfied, then Onset for the present frame would be deemed true.

Next, rate selection method 400 proceeds to step 412, where a second test is performed to determine whether Onset for the present frame is true. If Onset is true, then method 400 continues to step 414, where the coding rate is set at 8.5 Kbps, and rate selection method 400 continues to step 424. If Onset is determined to be false at step 412, then method 400 continues to step 416. At step 416, a third test is performed to determine if (a) the present frame is classified in class 3, (b) K0 is less than approximately −0.8, (c) Rp1 is less than approximately 0.5, and (d) Shp is less than approximately 0.15. If so, then method 400 continues to step 418, where the coding rate is set at 8.5 Kbps, and rate selection method 400 continues to step 424. Otherwise, method 400 proceeds to step 420.

At step 420 of rate selection method 400, a fourth test is performed to determine if (a) the NSR is greater than approximately 0.025, (b) the frame is classified in a class greater than class 2, and (c) the Rp1 is greater than approximately 0.57. If all the parameters (a)–(c) is satisfied, then method 400 continues to step 422, where the coding rate is set at 8.5 Kbps. After step 420 or 422, method 400 proceeds to step 424.

At step 424 of method 400, a fifth test is performed to determine if (a) the energy of the present frame ("Eng") is less than approximately the frame length ("L_frm") multiplied by approximately 2500, or (b) the frame energy is less than approximately the frame length multiplied by approximately 5000 and Class_m is below 3 and the Rp1 is less than approximately 0.6. If the fifth test of step 424 determines that either of the parameters (a) or (b) is satisfied, then method 400 continues to step 426, where the coding rate is set at 4.0 Kbps. If it is instead determined that neither of the parameters (a) nor (b) is satisfied, then method 400 proceeds to step 428.

At step 428 of rate selection method 400, a sixth test is performed to determine if (a) the present frame is classified in class 1, (b) the Rp0 is less than approximately 0.5, (c) the Rp1 is less than approximately 0.5, (d) the Rp2 is less than approximately 0.5, and (e) either K0 is greater than approximately 0 and Shp is greater than approximately 0.15, or Shp is greater than approximately 0.25. If so, then method 400 continues to step 430, where the coding rate is set at 2.0 Kbps. On the other hand, if the sixth test of step 428 results in negative, i.e. if one or more of the parameters (a)–(e) is false, then method 400 proceeds to step 432.

At step 432 of method 400, a seventh test is performed to determine if (a) the present frame is classified in class 1, (b) the NSR is greater than approximately 0.08, and (c) the Shp is greater than approximately 0.15. If so, then method 400 continues to step 434, where the coding rate is set to 2.0 Kbps. Otherwise, following step 432, method 400 proceeds to step 436, where an eighth test is performed to determine whether the present frame is classified in class 0. If the eighth test of step 436 determines that the frame is classified in class 0, then the coding rate is set at 0.8 Kbps at step 440. Otherwise, rate selection method 400 proceeds to, and ends at, step 442 with the default rate setting of 4.0 Kbps as the selected rate to code the present frame. Although not shown, steps 430, 434 and 438 also end at step 440, wherein the present frame is coded at 2.0 Kbps if step 440 is entered from one of steps 430 or 434, or at 0.8 Kbps if step 440 is entered from step 438.

The methods and systems presented above may reside in software, hardware, or firmware on the device, which can be implemented on a microprocessor, digital signal processor, application specific IC, or field programmable gate array ("FPGA"), or any combination thereof, without departing from the spirit of the invention. Furthermore, the present invention may be embodied in other specific forms without departing from its spirit or essential characteristics. The described embodiments are to be considered in all respects only as illustrative and not restrictive.

What is claimed is:

1. A method of selecting a coding rate for coding a plurality of frames of a speech signal at an average bit rate, said method comprising:

obtaining a mode indicative of said average bit rate, wherein said mode is one of a premium mode, a standard mode and an economy mode;

classifying a frame of said plurality of frames as being in a class from a plurality of classes, wherein said plurality of classes include a first class indicative of background noise or silence, a second class indicative of noise-like unvoiced speech, a third class indicative of pulse-like unvoiced speech, a fourth class indicative of transition into voiced speech, a fifth class indicative of unstable voiced speech, and a sixth class indicative of stable voiced speech;

selecting from one of a premium algorithm, a standard algorithm and an economy algorithm corresponding to said mode, wherein each of said premium algorithm, said standard algorithm and said economy algorithm is different but each uses said class, a noise-to-signal ratio (NSR), a pitch correlation of a first half of said frame (Rp1), a pitch correlation of a second half of said frame (Rp2) and a sharpness of said frame (Shp) to determine said coding rate; and setting said coding rate for said frame at one of a plurality of rates according to said selected algorithm.

2. The method of claim 1, wherein said plurality of rates include approximately 8.5 Kbps, 4.0 Kbps, 2.0 Kbps and 0.8 Kbps, and wherein said mode is indicative of said average bit rate being no greater than a pre-determined average bit rate.

3. The method of claim 2, wherein said coding rate is set at approximately 8.0 Kbps.

4. The method of claim 2, wherein said coding rate is set at approximately 4.0 Kbps if said class of said frame is in said second class, said Shp of said frame is greater than approximately 0.2, said Rp1 of said frame is less than approximately 0.32 and said Rp2 of said frame is less than approximately 0.3.

5. The method of claim 2, wherein said coding rate is set at approximately 4.0 Kbps if said class of said frame is in said second class, said NSR is greater than approximately 0.15, said Rp1 of said frame is less than approximately 0.5 and said Rp2 of said frame is less than approximately 0.5.

6. The method of claim 2, wherein said coding rate is set at approximately 4.0 Kbps if said class of said frame is in said first class, second class or third class, said NSR is greater than approximately 0.5, a reflection coefficient (K0) of said frame is less than approximately 0.0 and said Rp1 of said frame is less than approximately 0.5.

7. The method of claim 2, wherein said coding rate is set at approximately 0.8 Kbps if said class of said frame is in said first class and a class of a previous frame of said frame is in said first class.

8. The method of claim 1, wherein said mode is indicative of said average bit rate being no greater than approximately 70% of a pre-determined average bit rate.

9. The method of claim 8, wherein said coding rate is set at approximately 4.0 Kbps if said class of said frame is in said fourth class, a class of a previous frame of said frame is in said sixth class, a pitch correlation of a second half of a preceding frame (Rp0) of said frame is greater than a threshold and said Rp1 of said frame is greater than said threshold.

10. The method of claim 9, wherein said threshold is the greater of 0.77-NSR and 0.7.

11. The method of claim 8, wherein said coding rate is set at approximately 4.0 Kbps if said class of said frame is in said third class, a pitch correlation of a second half of a preceding frame (Rp0) of said frame is greater than approximately 0.31 and said Rp1 of said frame is greater than approximately 0.31.

12. The method of claim 8, wherein said coding rate is set at approximately 4.0 Kbps if said class of said frame is in said third class and said Shp of said frame is greater than approximately 0.18.

13. The method of claim 8, wherein said coding rate is set at approximately 4.0 Kbps if said class of said frame is in said third class and said NSR of said frame is greater than approximately 0.5.

14. The method of claim 8, wherein said coding rate is set at approximately 4.0 Kbps if said class of said frame is in said second class.

15. The method of claim 8, wherein said coding rate is set at approximately 2.0 Kbps if a pitch correlation of a second half of a preceding frame (Rp0) of said frame is less than approximately 0.5, said Rp1 of said frame is less than approximately 0.5, said Rp2 of said frame is less than approximately 0.5 and ((a reflection coefficient (K0) of said frame is greater than approximately 0.0 and said Shp of said frame is greater than approximately 0.15) or approximately 0.25).

16. The method of claim 8, wherein said coding rate is set at approximately 2.0 Kbps if said NSR is greater than approximately 0.08 and said Shp of said frmae is greater than approximately 0.15.

17. The method of claim 8, wherein said coding rate is set at approximately 0.8 Kbps if said class of said frame is in said first class.

18. The method of claim 1, wherein said plurality of rates include approximately 8.5 Kbps, 4.0 Kbps, 2.0 Kbps and 0.8 Kbps, and wherein said mode is indicative of said average bit rate being no greater than approximately 55% of a pre-determined average bit rate.

19. The method of claim 18, wherein said pre-determined average bit rate is the Enhanced Variable Rate Codec average bit rate.

20. The method of claim 18, wherein said coding rate is set at approximately 4.0 Kbps.

21. The method of claim 18, wherein said coding rate is set at approximately 8.5 Kbps if said class of said frame is in said fourth class, fifth class, or sixth class, onset for a previous frame of said frame is true and said NSR is greater than approximately 0.02 or a Ditch correlation of a second half of a preceding frame (Rp0) of said frame is less than approximately 0.85.

22. The method of claim 18, said coding rate is set at approximately 8.5 Kbps if onset for said frame is true.

23. The method of claim 18, wherein said coding rate is set at approximately 8.5 Kbps if said class of said frame is in said fifth class or sixth class, a reflection coefficient (K0) of said frame is less than approximately −0.8, said Rp1 of said frame is less than approximately 0.5 and said Shp of said frame is less than approximately 0.15.

24. The method of claim 18, wherein said coding rate is set at approximately 8.5 Kbps if said class of said frame is in said fourth, fifth class or sixth class, said NSR is greater than approximately 0.025 and said Rp1 of said frame is less than approximately 0.57.

25. The method of claim 24, wherein said coding rate is set at approximately 4.0 Kbps if an energy of said frame is less than approximately a length of said frame multiplied by approximately 2500 or said class of said frame is in said first, second class or third class, and said Rp1 of said frame is less than approximately 0.6 and said energy of said frame is less than approximately said length of said frame multiplied by approximately 5000.

26. The method of claim 18, wherein said coding rate is set at approximately 2.0 Kbps if said class of said frame is in said second class, a pitch correlation of a second half of a preceding frame (Rp0) of said frame is less than approximately 0.5, said Rp1 of said frame is less than approximately 0.5, said Rp2 of said frame is less than approximately 0.5 and ((a reflection coefficient (K0) of said frame is greater than approximately 0.0 and said Shp of said frame is greater than approximately 0.15) or said Shp of said frame is greater than approximately 0.25).

27. The method of claim 18, wherein said coding rate is set at approximately 2.0 Kbps if said class of said frame is in said second class, said NSR is greater than approximately 0.08 and said Shp of said frame is greater than approximately 0.15.

28. The method of claim 18, wherein said coding rate is set at approximately 0.8 Kbps if said class of said frame is in said first class.

29. The method of claim 1, wherein each of said premium algorithm, said standard algorithm and said economy algorithm further uses a reflection coefficient (K0) of said frame to determine said coding rate.

30. An encoding system capable of selecting a coding rate for coding a plurality of frames of a speech signal at an average bit rate, said encoding system comprising:

a mode signal indicative of said average bit rate, wherein said mode signal is one of a premium mode, a standard mode and an economy mode;

a speech analyzing module capable of classifying a frame of said plurality of frames as being in a class from a plurality of classes, wherein said plurality of classes include a first class indicative of background noise or silence, a second class indicative of noise-like unvoiced speech, a third class indicative of pulse-like unvoiced speech, a fourth class indicative of transition into voiced speech, a fifth class indicative of unstable voiced speech, and a sixth class indicative of stable voiced speech; and a noise-to-signal ratio (NSR) module capable of determining said NSR;

a pitch correlation module capable of determining a pitch correlation of a first half of said frame (Rp1) and a pitch correlation of a second half of said frame (Rp2);

a sharpness module capable of determining a sharpness of said frame (Shp);

a rate selecting module capable of setting said coding rate for said frame at one of a plurality of rates according to a selected algorithm from one of a premium algorithm, a standard algorithm and an economy algorithm corresponding to said mode signal, wherein each of said premium algorithm, said standard algorithm and said economy algorithm is different but each uses said class, said NSR, said Rp1, said Rp2 and said Shp to determine said coding rate.

31. The encoding system of claim 30, wherein said plurality of rates include approximately 8.5 Kbps, 4.0 Kbps, 2.0 Kbps and 0.8 Kbps, and wherein said mode signal is indicative of said average bit rate being no greater than a pre-determined average bit rate.

32. The encoding system of claim 31, wherein said coding rate is set at approximately 0.8 Kbps if said class of said frame is in said first class and a class of a previous frame of said frame is in said first class.

33. The encoding system of claim 30, wherein said plurality of rates include approximately 8.5 Kbps, 4.0 Kbps, 2.0 Kbps and 0.8 Kbps, and wherein said mode signal is indicative of said average bit rate being no greater than approximately 70% of a pre-determined average bit rate.

34. The encoding system of claim 33, wherein said coding rate is set at approximately 0.8 Kbps if said class of said frame is in said first class.

35. The encoding system of claim 30, wherein said mode signal is indicative of said average bit rate being no greater than approximately 55% of a pre-determined average bit rate.

36. The encoding system of claim 35, wherein said coding rate is set at approximately 2.0 Kbps if said class of said frame is in said second class, said NSR is greater than approximately 0.08 and said Shp of said frame is greater than approximately 0.15.

37. The encoding system of claim 35, wherein said coding rate is set at approximately 0.8 Kbps if said class of said frame is in said first class.

38. The encoding system of claim 30, wherein each of said premium algorithm, said standard algorithm and said economy algorithm further uses a reflection coefficient (K0) of said frame to determine said coding rate.

* * * * *

UNITED STATES PATENT AND TRADEMARK OFFICE

CERTIFICATE OF CORRECTION

PATENT NO. : 7,054,809 B1
APPLICATION NO. : 10/126307
DATED : May 30, 2006
INVENTOR(S) : Yang Gao It is certified that error appears in the above-identified patent and that said Letters Patent is hereby corrected as shown below:

In the claims, column 11, line 4, --determining a noise-to-signal ratio (NSR);
determining a pitch correlation of a first half of said frame (Rp1);
determining a pitch correlation of a second half of said frame (Rp2);
determining a sharpness of said frame (Shp);--
should be inserted immediately after "stable voice speech;"

In the claims, column 12, line 38, "Ditch" should be changed to --pitch--.

Signed and Sealed this

Second Day of January, 2007

JON W. DUDAS
*Director of the United States Patent and Trademark Office*